US007172354B1

(12) United States Patent
Nissim

(10) Patent No.: US 7,172,354 B1
(45) Date of Patent: Feb. 6, 2007

(54) SELF-CONTAINED EDGE PRINTER

(75) Inventor: Yosi Nissim, West Hills, CA (US)

(73) Assignee: Y. Nissim, Inc., Chatsworth, CA (US)

( * ) Notice: Subject to any disclaimer, the term of this patent is extended or adjusted under 35 U.S.C. 154(b) by 230 days.

(21) Appl. No.: 11/010,126

(22) Filed: Dec. 9, 2004

(51) Int. Cl.
*B41J 2/01* (2006.01)
*B41J 13/10* (2006.01)

(52) U.S. Cl. ..... 400/642; 400/88; 400/691; 347/104; 347/108

(58) Field of Classification Search ..... 400/88, 400/642, 643, 645.1, 691, 693; 347/2, 4, 347/104, 108, 109; 346/143, 145; 271/3.17, 271/225
See application file for complete search history.

(56) References Cited

U.S. PATENT DOCUMENTS 4,721,968 A * 1/1988 Arai et al. ..... 346/136
5,373,350 A 12/1994 Taylor
5,497,250 A 3/1996 Kawashima
5,538,237 A * 7/1996 Miyauchi ..... 271/117
D372,733 S 8/1996 Yoshida
D377,370 S 1/1997 Escobedo
5,601,018 A 2/1997 Iimura
6,007,194 A * 12/1999 Yokoyama et al. ..... 347/104
D428,052 S 7/2000 Dwyer
D430,896 S 9/2000 Wong
6,418,279 B1 7/2002 Weinberger
6,512,856 B1 1/2003 Davis
6,618,563 B2 9/2003 Oakeson
2002/0131075 A1 9/2002 Kremer
2004/0158655 A1 8/2004 Kremer
2004/0205465 A1 10/2004 Baker
2005/0122359 A1* 6/2005 Chelvayohan ..... 347/16

* cited by examiner

*Primary Examiner*—Leslie J. Evanisko
(74) *Attorney, Agent, or Firm*—Thomas I. Rozsa; Tony D. Chen

(57) ABSTRACT

A self-contained edge printing machine which can print any sequence of numbers or letters adjacent the top edge or adjacent the bottom edge of a standard 8½" by 11" piece of paper. The machine is a stand-alone self-contained unit that has its own stationary inkjet printer and its own internal computer.

8 Claims, 7 Drawing Sheets

30
32
28
29
14
27
46

SELF-CONTAINED EDGE PRINTER

BACKGROUND OF THE INVENTION

1. Field of the Invention

The present invention relates to the field of devices which imprint sequential alphanumeric letters and numbers onto successive sheets of paper.

2. Description of the Prior Art

The following thirteen (13) patents and published patent applications are the closest prior art references.

1. U.S. Pat. No. 5,373,350 issued to Taylor on Dec. 13, 1994 for "Xerographic/Thermal Ink Jet Combined Printing" (hereafter the "Taylor Patent");

2. U.S. Pat. No. 5,497,250 issued to Kawashima on Mar. 5, 1996 for "Document Scanning Apparatus Having A Stamp And method For Controlling The Stamping Position" (hereafter the "Kawashima Patent");

3. U.S. Pat. No. Des. 372,733 issued to Yoshida on Aug. 13, 1996 for "Thermal Printer" (hereafter the "Yoshida Patent");

4. U.S. Pat. No. Des. 377,370 issued to Escobedo on Jan. 14, 1997 for "Combined Ink-Jet Printer, Facsimile And Copier" (hereafter the "Escobedo Patent");

5. U.S. Pat. No. 5,601,018 issued to Iimura on Feb. 11, 1997 for "Automatic Stamping Device" (hereafter the "Iimura Patent");

6. U.S. Pat. No. Des. 428,052 issued to Dwyer on Jul. 11, 2000 for "Inkjet Printer" (hereafter the "Dwyer Patent");

7. U.S. Pat. No. Des. 430,896 issued to Wong on Sep. 12, 2000 for "Image Transfer Device" (hereafter the "Wong Patent");

8. U.S. Pat. No. U.S. Pat. No. 6,418,279 B1 issued to Weinberger on Jul. 9, 2002 for "Paper Processing System" (hereafter the "Weinberger Patent");

9. United States Patent Application Publication No. US 2002/0131075 A1 issued to Kremer on Sep. 19, 2002 for "Tab Modification System For Printing Machine" (hereafter the "Kremer Patent");

10. U.S. Pat. No. 6,512,856 B1 issued to Davis on Jan. 28, 2003 for "System And method For Information Stamping A Digitized Image" (hereafter the "Davis Patent");

11. U.S. Pat. No. 6,618,563 B2 issued to Oakeson on Sep. 9, 2003 for "System And Method For Printing On A Print medium With A Combination Laser And Ink Jet Printer" (hereafter the "Oakeson Patent");

12. United States Patent Application Publication No. US 2004/0158655 A1 to Kremer on Aug. 12, 2004 for "Automatic Insertion Of Special Pages Into Black & White Digital Printing Jobs" (hereafter the "Kremer Patent");

13. United States Patent Application Publication No. US 2004/0205465 A1 to Baker on Oct. 14, 2004 for "Method Of Electronically Producing Documents In A Legal Proceeding" (hereafter the "Baker Patent").

The Taylor Patent involves combining an inkjet printer with a photocopying machine. A thermal inkjet printer can print annotated messages onto a document which is being photocopied. The Taylor patent discloses a large non-portable machine which does not involve printing sequential alphanumeric characters adjacent an edge of a sheet of paper.

The Kawashima Patent deals with a document scanning apparatus having a stamping device which has a controller that controls the stamping position.

The Yoshida Patent is a design patent which protects the design shape of a thermal printer.

The Escobedo Patent is a design patent that protects the design shape of a combined inkjet printer, facsimile and copier.

The Iimura Patent is a complicated document reading device that includes a stamp memory control circuit which provides various stamp image data on the basis of the number of documents or the number of sheets of paper already printed.

The Dwyer Patent is a design patent which protects the design shape of an inkjet printer.

The Wong Patent is a design patent which protects the design shape of an image transfer device.

The Weinberger Patent discloses a large non-portable paper processing system for marking original documents including a document feeder, a printer for printing annotation on the document, an inverter to turn the document onto its first side and a stacker to stack the printed documents. In Weinberger, the annotation is printed while the document is face up and then the document is inverted. It is believed that printing the annotation before or after the inversion process does not provide as sharp and defined print annotation as desirable. The Weinberger device also scans the document to determine whether or not they should print the annotation.

The '2002 published Kremer Patent Application discloses the concept of selecting a marker on a printed document, displaying the location of the marker on the display device in the machine, modifying the marker and placing the marker in the document.

The Davis Patent discloses the concept of using a scanned image and electronically stamping the image on a document.

The Oakeson Patent discloses a method for printing on a print medium with a combination laser and inkjet printer. The system discloses an inkjet head assembly attached to a printer structure of the printer for printing a code or other information on the print medium.

The method disclosed in the 20004 Kremer discloses the concept of printing a document from a digital file which includes storing an input document in a machine readable form.

The published Baker patent application also discloses a method of scanning a document, storing the document in a computer and putting the document in a PDF file format and digitally numbering the document.

In spite of the prior art of record, none of the prior art discloses an efficient way to print characters adjacent the top edge or bottom edge of a sheet of paper in a clean, sharp efficient manner through a small self-contained portable unit. There exists a significant need for such a machine.

SUMMARY OF THE INVENTION

The present invention is a self-contained edge printing machine which can print any sequence of numbers or letters adjacent the top edge or adjacent the bottom edge of a standard 8½" by 11" piece of paper. The present invention is a stand-alone self-contained unit that has its own stationary inkjet printer and its own internal computer.

It has been discovered, according to the present invention, that if an edge printer has its own internal computer and a keypad to input commands with defaulted preprogrammed lines that can be selected in advance, then through use of the microprocessor, any desired set of alphanumeric characters can be printed adjacent a top edge or bottom edge of sheets of paper with the characters being sequenced so that each successive sheet of paper is printed with the next sequence of letters and/or numbers.

It has also been discovered, according to the present invention, that if the paper is inserted in the machine by feed rollers and separator rollers to individually separate the top sheet in a stack to be imprinted, and the sheet of paper is then guided into a space between arcuate tracks which causes the paper to make a U-turn and be inverted, then if the track has an opening to permit a printhead to imprint characters on the paper at the exact location of the midpoint of the semi-circle of the arcuate track, then clean, crisp alphanumeric printing can be achieved adjacent a top edge or bottom edge of the sheet of paper.

It has also been discovered, according to the present invention, that if the preprogrammed commands select the location along the edge of the paper where characters are to be imprinted, then the feed pulleys, separator pulleys and inverter pulleys cause the location along the edge of the paper to be aligned with the gap in the track so that the printing can be imprinted at the desired location.

It has additionally been discovered, according to the present invention, that the ideal word and number character length is one inch or less, thereby providing eight separate locations along an 8½" top or bottom edge of a sheet of 8½" by 11" paper for imprinting.

It is therefore an object of the present invention to provide a self-contained edge printer with its own internal computer and command keyboard to enable any sequence of alphanumeric characters to be imprinted at any desired location along the top edge or bottom edge of an 8½" by 11" sheet of paper.

It is also an object of the present invention to provide an edge printer using an inkjet printer with a print head that is at the same location and which will imprint any desired sequence of alphanumeric characters on successive sheets of paper when the sheet is in the middle of an inversion sequence at the location of the center of the inversion track semi-circle.

It is also an object of the present invention to provide an edge printer which can detect the leading edge of the sheet of paper so that the paper can be adjusted to the desired printing location before it reaches the printer head.

It is a further object of the present invention to provide a means to sense when a printed sheet is about to be ejected so that a signal can be sent to the sensor and feeder pulley to pull in the next successive sheet for imprinting.

It is an additional object of the present invention to provide a self-contained stand-alone portable edge printer which can be easily relocated and which will print successive sheets of paper such as Bates numbering, page numbering etc.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
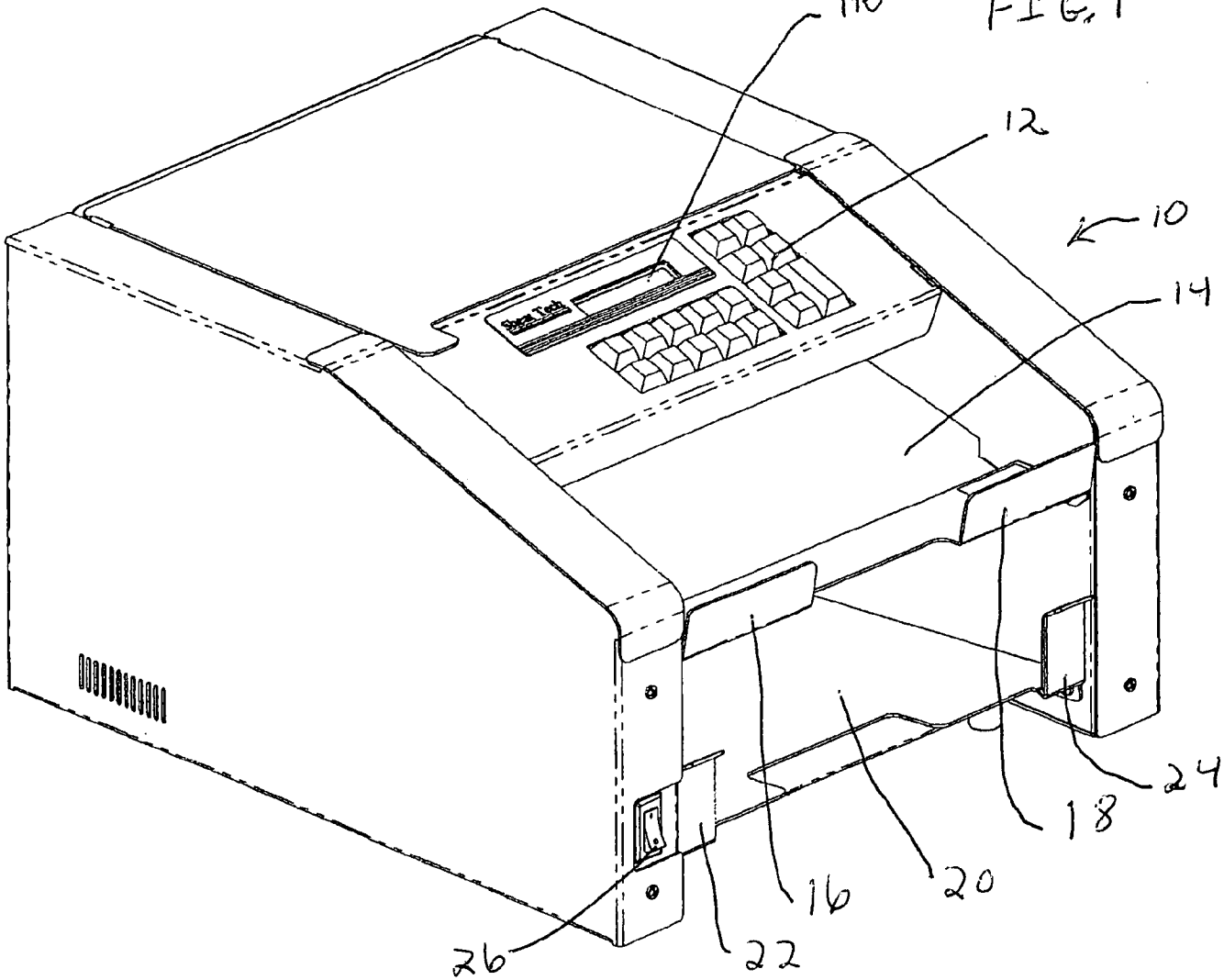
FIG. 1 is an exterior perspective view of the present invention edge printer.

Referring to FIG. 1, there is illustrated an exterior perspective view of the present invention edge printer 10. A keypad 12 is positioned on the top front portion of the edge printer 10. The desired sequence of characters which, by way of example, can be any desired sequence of numbers and letters, are input through keypad 12 to an internal computer (which will be discussed later) so that the desired sequence of characters can be printed at any desired location adjacent the top edge and/or the bottom edge of an 8½" by 11" piece of paper. A display 110 to show what has been input is located above the keypad 12.

Immediately in front of and below the keypad 12 is the document ramp platform 14. The paper onto which characters are to be printed is placed onto the ramp platform 14 so that its longer 11" side abuts front stops 16 and 18 located at the bottom edge of ramp platform 14.

Located below the ramp platform 14 is the collection stacker tray 20 which retains the sheets of paper after desired characters have been imprinted at a desired location along a top edge and/or a bottom edge. First and second stops 22 and 24 are located along the front edge of collection stacker tray 20 to prevent the paper from flying out of the edge printer 10. An on/off switch 26 is located adjacent first stop 22.

Figure 3:
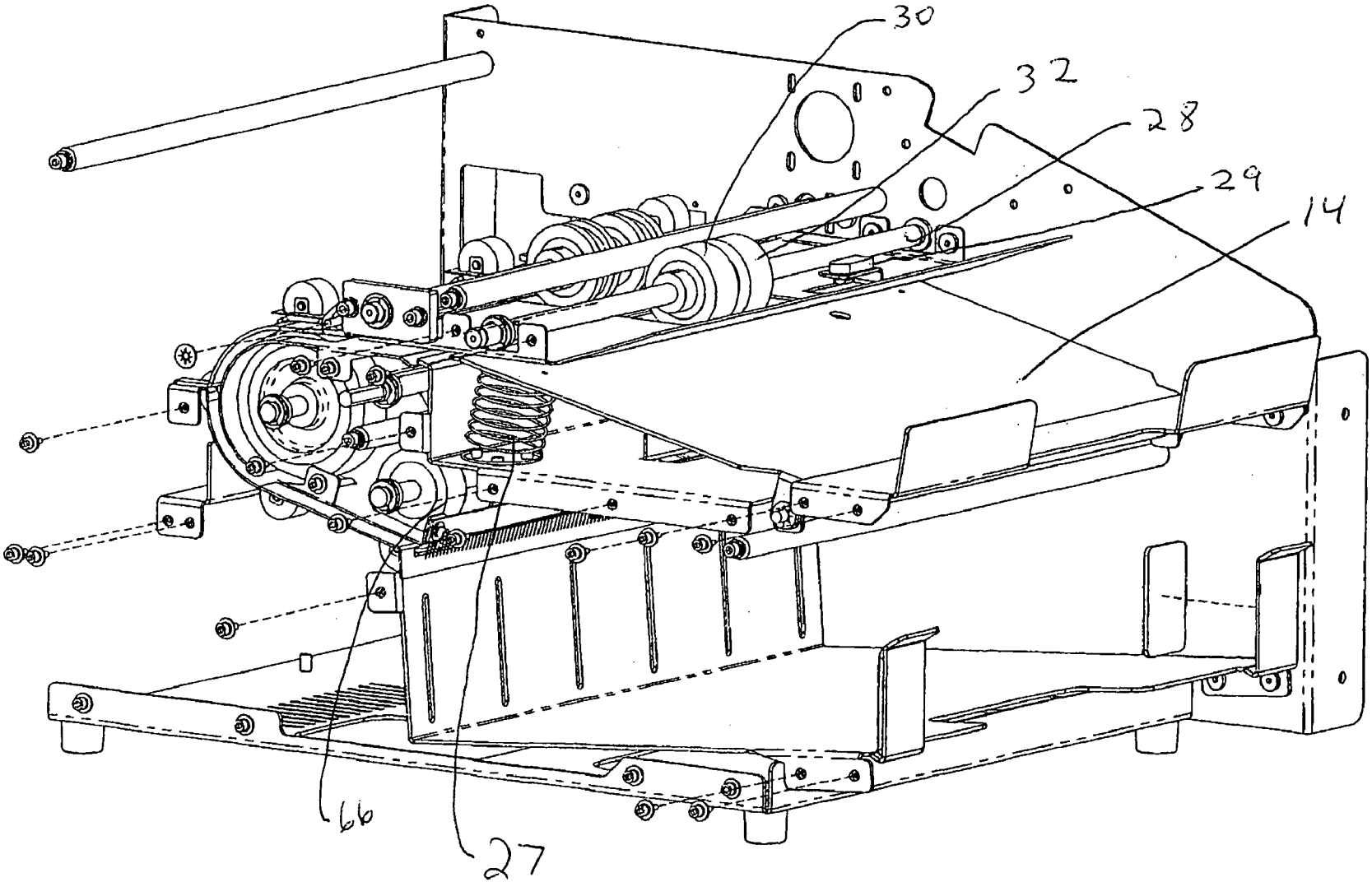
FIG. 3 is a detailed perspective view of the interior mechanisms of the present invention edge printer when viewed from the left side.
Figure 5:
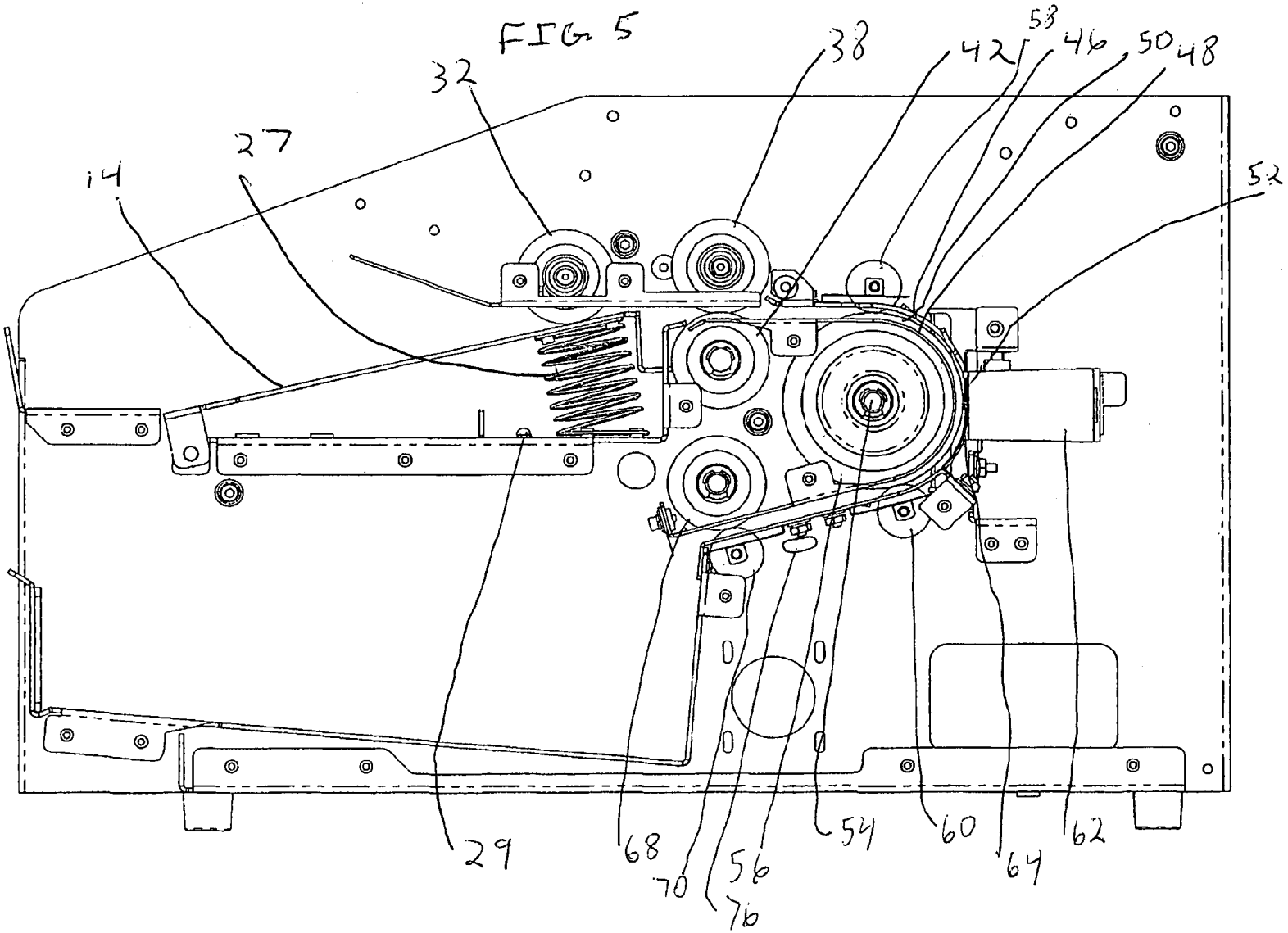
FIG. 5 is a detailed interior view of the interior mechanisms of the present invention edge printer when viewed from the right side.

Referring to FIGS. 3 and 5, a spring means 27 which by way of example can be a coil spring, pushes ramp platform 14 upwardly so that when a stack of paper is placed on the ramp platform 14, the stack of paper is pushed outwardly to enable the topmost sheet of paper to come in contact with the feed pulleys of the edge printer 10.

Figure 6:
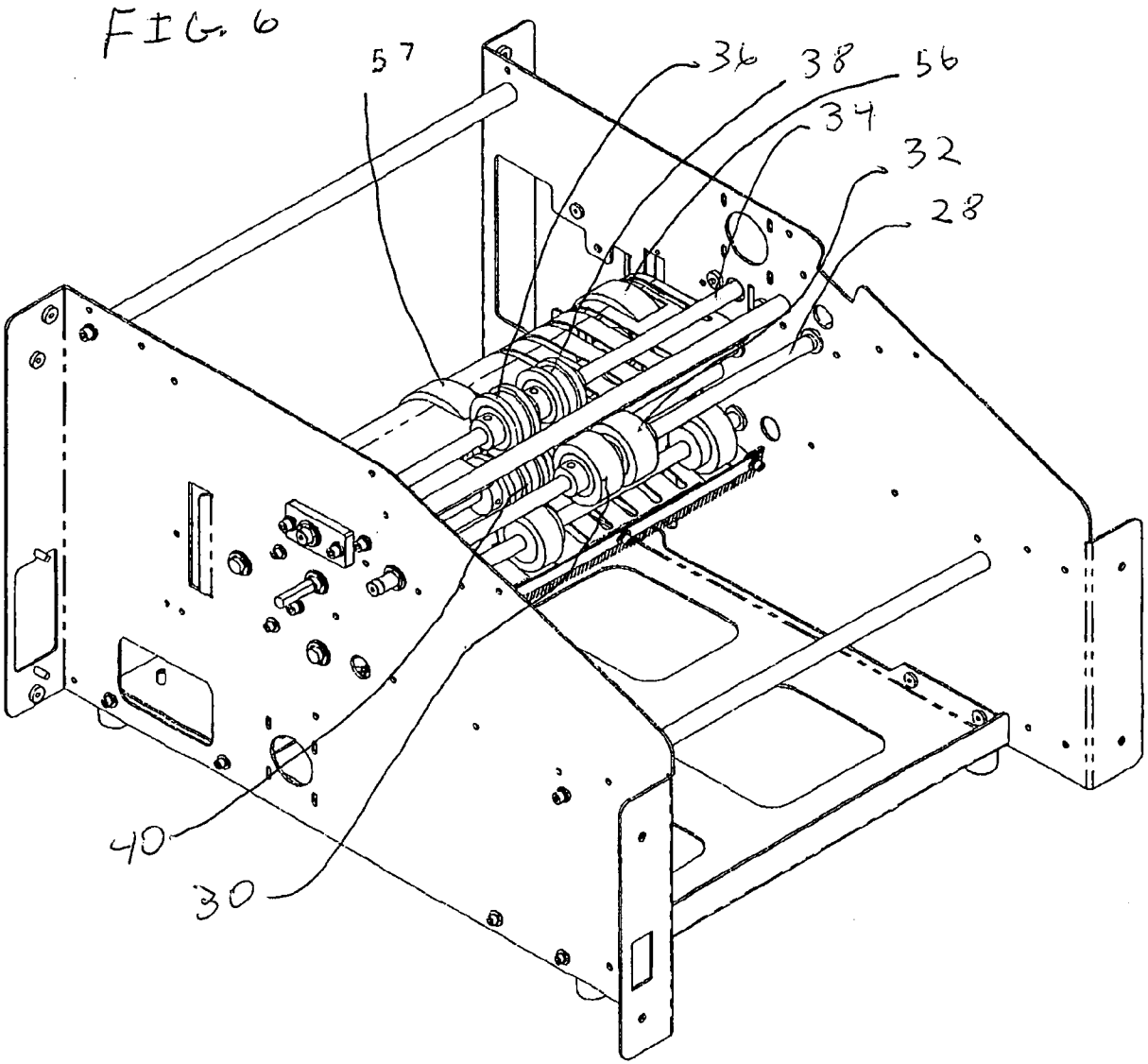
FIG. 6 is a detailed perspective view of the interior pulley mechanisms of the present invention edge printer.

Referring to FIGS. 3, 5 and 6, immediately above ramp platform 14 on shaft 28 are two feeder pulleys 30 and 32. A document sensor 29 senses that paper is in the ramp platform 14 so the pulleys are activated. The first feeder pulley 30 and the second feeder pulley 32 rotate in a counterclockwise direction and serve to partially separate the top sheet of paper and feed it into the edge printer 10. The paper then travels to a pair of separator pulleys which completely separate the top sheet of paper from the remaining stack of papers.

Figure 7:
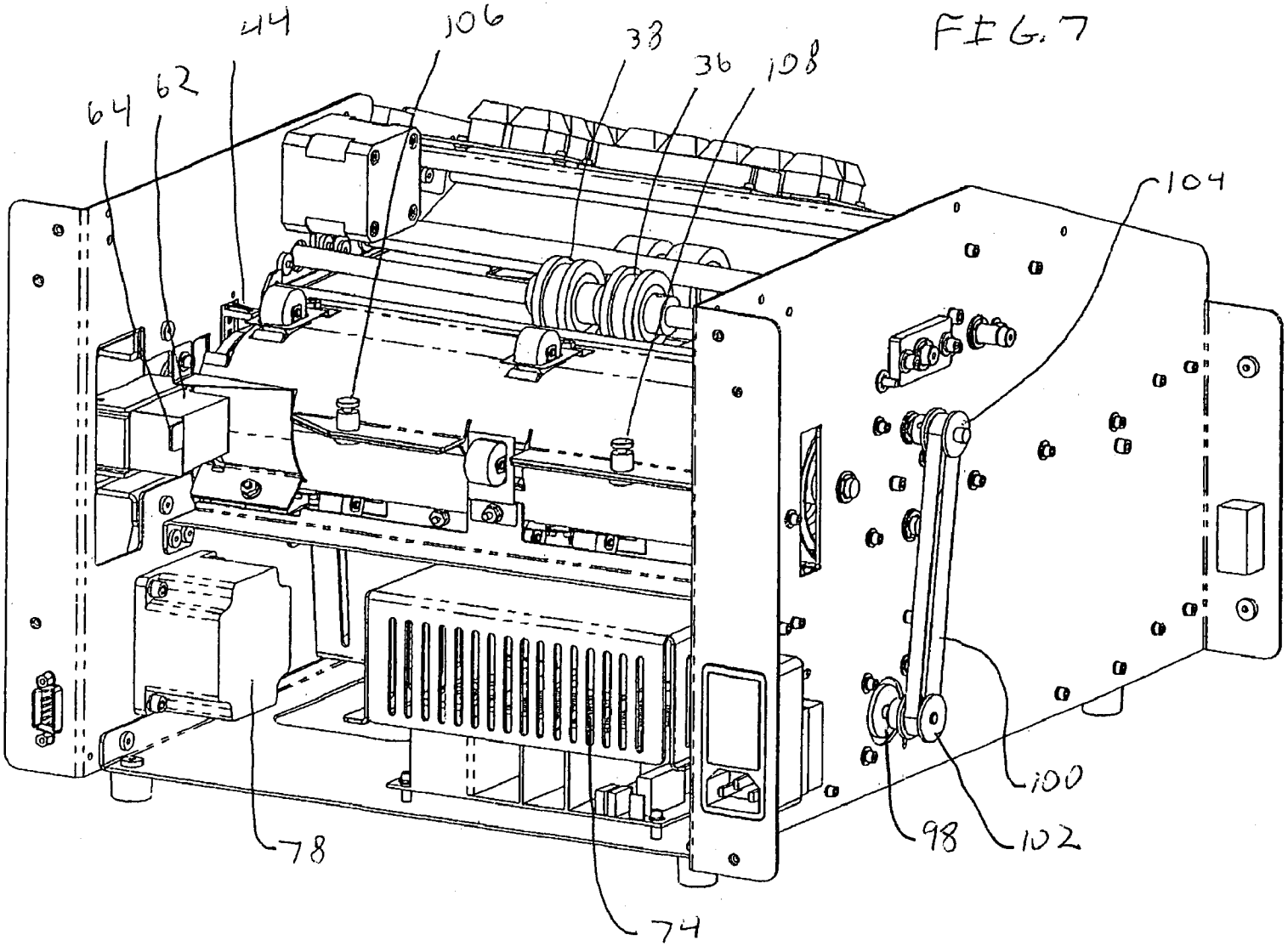
FIG. 7 is a detailed perspective view of the interior mechanisms of the present invention when viewed from the rear.

Referring to FIG. 6, shaft 34 supports first top separator pulley 36 and second top separator pulley 38. First and second top separator pulleys 36 and 38 rotate in the counter-clockwise direction. Aligned with an intermeshed with each respective top separator pulley is a bottom separator pulley. Referring to FIG. 6, first bottom separator pulley 40 is aligned with first top separator pulley 36. A parallel second bottom separator pulley 42 is aligned with second top separator pulley 38 (see FIG. 5). The first and second bottom separator pulleys 40 and 42 rotate in the clockwise direction. The pairs of separator pulleys 36, 38, 40 and 42 separate the top sheet of paper from the remaining stack of papers. Referring to FIG. 7, a sensor 44 serves to sense the leading edge of the separated top sheet of paper.

Figure 4:
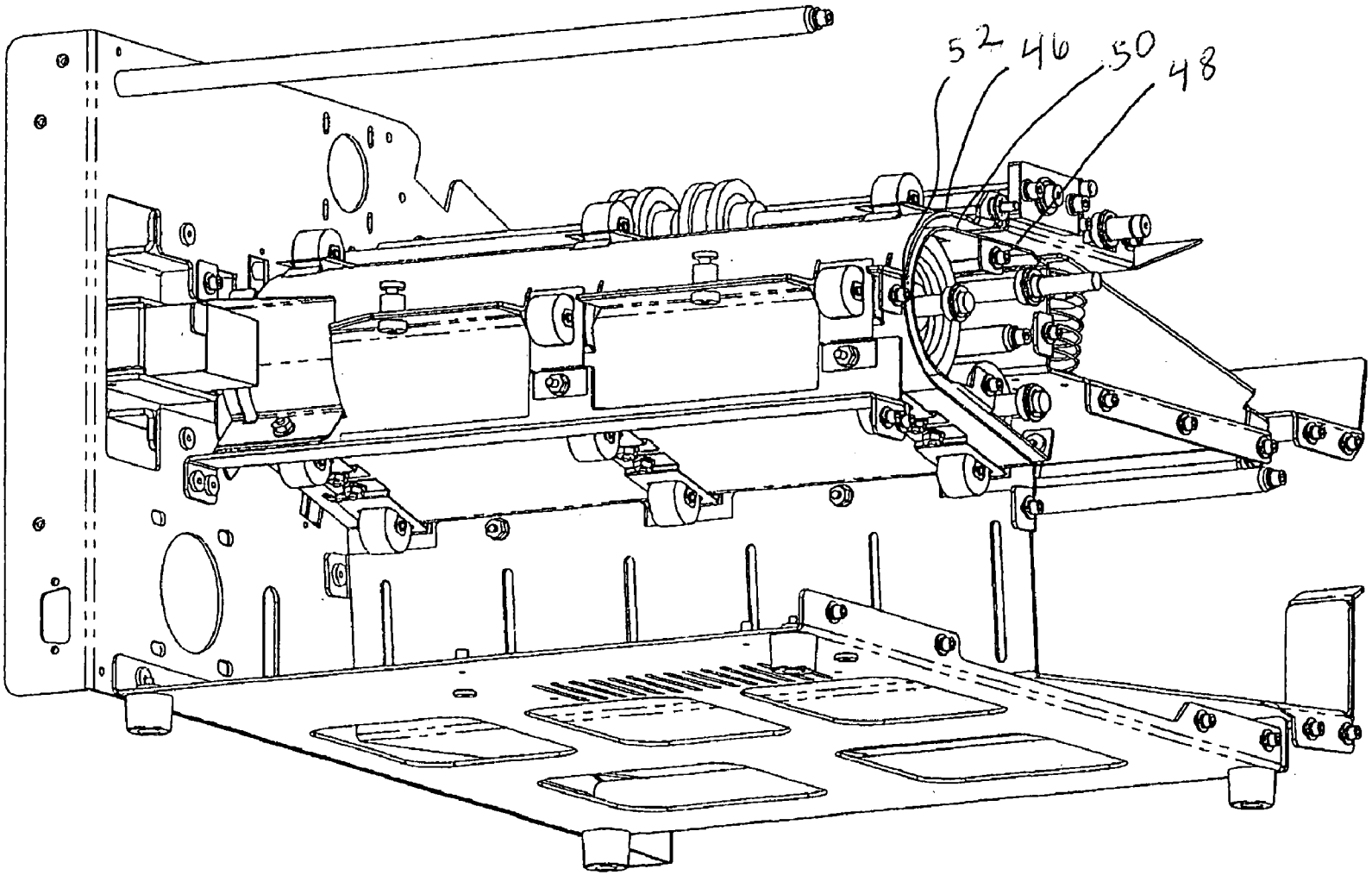
FIG. 4 is a detailed perspective view of the interior mechanisms of the present invention edge printer when viewed from the rear.

Referring to FIGS. 4 and 5, the top sheet of paper is then forced to travel between a pair of parallel spaced apart arcuate tracks, an outer arcuate track 46 and a spaced apart parallel inner arcuate track 48 with a gap 50 between them. The arcuate tracks are initially aligned horizontally and then turn in a semi-circle, as best illustrated in FIG. 5. Inner arcuate track 48 is solid but outer arcuate track 46 has a gap 52 at the center point of its semicircular section. Positioned inside inner arcuate track 48 are a series of inverter pulleys supported on a shaft. Referring to FIG. 5, shaft 54 supports the parallel spaced apart inverter pulleys of which one inverter pulley 56 is illustrated. A second inverter pulley 57 is illustrated in FIG. 6. The paper passes within the gap 50 between arcuate tracks 46 and 48 and is pulled by inverter pulleys 56 and 57. Idlers 58 and 60 (see FIG. 5) are on the opposite side of the paper. A third idler pulley is adjacent the print head. A stationary inkjet printer 62 with a print head 64 is positioned at the location of the gap 52 in outer arcuate track 46. (See FIGS. 5 and 7)

A key innovative feature of the present invention is that the characters along the edge of the sheet of paper are printed onto the paper while the paper is in the middle of the inversion process. The sensor 44 advises the stationary inkjet printer 62 that the paper is about to arrive and the inkjet printer 62 causes the print head 64 to imprint the characters onto the paper. The print head 64 is aligned with gap 52 and spray prints the characters onto the paper at the location of the center of the semicircular arc of the arcuate tracks 46 and 48.

After being imprinted at the desired location on the edge of the sheet of paper, the sheet of paper then continues to travel in the gap 50 between outer arcuate track 46 and inner arcuate track 48 and travels to ejection pulleys 66 (see FIG. 3) and 68 (see FIG. 5). An idler pulley is associated with each ejection pulley. Referring to FIG. 5, idler pulley 70 is aligned with second ejection pulley 68. The paper is then moved by the ejection pulleys 66 and 68 onto collection stacker tray 20.

Figure 2:
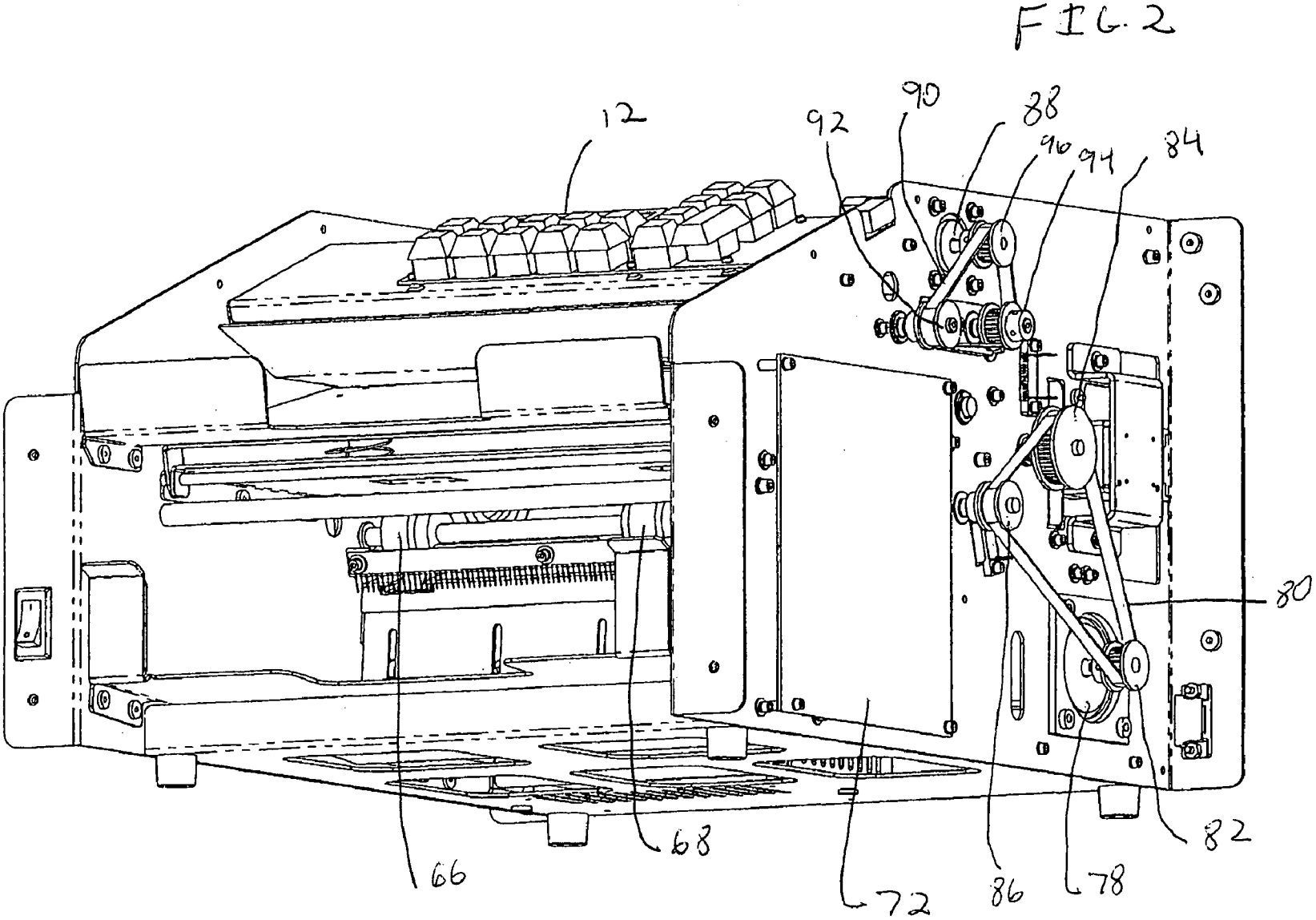
FIG. 2 is a detailed perspective view of the interior mechanisms of the present invention edge printer when viewed from the right side.

When the paper is placed onto the ramp platform 14, it is placed face up with the top edge of the paper closer to the first and second feeder pulleys 30 and 32 and the bottom edge of the paper adjacent front stops 16 and 18. The print head 64 of the inkjet printer can print any series of characters, with the preferred maximum width of word and number characters being approximately one (1) inch. Another innovation of the present invention is that the edge printer has its own self-contained computer. Referring to FIG. 2, the PC board 72 is shown. An internal power supply 74 (see FIG. 7) provides power to the unit. Through programming of the computer 72 with input from the keypad 12, the amount of characters to be imprinted along an edge of the paper is selected and the location along the edge of the paper is selected. The imprinting is performed along the 8½" edge of the paper and can be at any increment of one (1) inch from one lengthwise 11" edge to each other lengthwise 11" edge. Similarly, by input to the computer 72 from the keypad 12, the imprinting of characters can be along the top edge of the sheet of paper or along the bottom edge of the sheet of paper.

After the sheet of paper has been imprinted and before it gets to the ejection pulleys 66 and 68, a sensor 76 senses that the trailing edge of the paper is arriving and through the computer 72, tells the first and second feeder pulleys 30 and 32 to pull the next sheet of paper to be imprinted with characters.

The operation of the pulley system is best illustrated in FIGS. 2 and 7. A large stepper motor 78 will rotate a certain number of steps depending on how far the user wants the paper to move along an edge. The stepper motor 78 is connected by a belt 80 to three pulleys, a stepper motor pulley 82, an inverter shaft pulley 84 and an eject shaft pulley 86. Stepper motor pulley 82 is connected to the stepper motor 78. The inverter shaft pulley 84 is connected so shaft 54 on which the inverter pulleys 56 and 57 rotate. The eject shaft pulley 86 is connected to the shaft in which eject pulleys 66 and 68 rotate.

A first small stepper motor 88 causes rotation of the first and second feeder pulleys 30 and 32 and the first and second top separator pulleys 36 and 38. A belt 90 connects the first smaller stepper motor 88 to three pulleys, a feeder pulley 92, a top separator pulley 94 and a separator motor pulley 96. The separator motor pulley 96 is attached by a shaft to the first small separator motor 88. The feeder pulley 92 is attached on the shaft 28 on which first and second feeder pulleys 30 and 32 rotate. The top separator pulley 94 is attached on the shaft 34 on which the first and second separator pulleys 36 and 38 rotate.

Referring to FIG. 7, a second small separator motor 98 causes rotation of the lower 2 separator pulleys. A belt 100 connects the second stepper motor to two pulleys, a second stepper 3 motor pulley 102 and a lower separator pulley 104. The second stepper motor pulley 102 is attached by a shaft to second small stepper motor 98. The lower separator pulley 104 is attached on the shaft on which first and second bottom separator pulleys 40 and 42 are located.

Referring to FIG. 7, opening means such as pins 106 and 108 permit the interior at the edge printer 10 to be opened so that paper jams can be corrected.

Through use of the present invention, the 8½" by 11" piece of paper can be numbered in any desired set of letters and numbers at any desired location adjacent the top edge or the bottom edge of the paper. For example, for legal documents, the present invention edge printer can print Bates numbers. For medical records, it can print chart or item numbers. Any variety of lettering or numbering system at any location along the top or bottom edge can be achieved with the present invention edge printer 10.

The edge printer 10 utilizes an inkjet printer 62 which is stationary where the printer head 64 is stationary relative to the paper and is aligned with gap 52 to spray print characters on the paper. Through the computer input, the position at the edge of the paper is moved by the feeder pulleys 30 and 32 and the separator pulleys 36, 38, 40 and 42 so that the location adjacent the top or bottom edge where the characters are to be printed is aligned in the gap 52 with the inkjet printer head 64. This combined with the fact that the printing occurs at the time when the paper is in the middle of being inverted and at the location at the center of the semi-circle of the inversion creates an improved arcuate and completely flexible printing operation to imprint characters at any desired location adjacent a top or bottom edge of the paper. This printing mechanism is completely different from prior art inkjet printers where the inkjet printer head itself is moving over the paper and then the paper is indexed to the next line where the inkjet printer prints the next group of words on the next line.

Another key innovative feature of the present invention is that the present invention edge printer has its own internal power supply and its own internal printer. It is an independent printer. It has its own keyboard 12 and its own independent display 110 so that the user can verify what commands have been input to the computer 72 through the keyboard 12. The present invention edge printer 10 has the capability to print alphanumeric messages and increment them.

The present invention has defaulted preprogrammed lines that can be selected in advance. There is a microprocessor 72 inside the machine and because it comes with software, it allows the user to choose what he/she wants to print alphawise and numeric-wise and put it on the documents.

The characters which are imprinted can be for Bates numbering, page numbering, document marking and special messages to illustrate just some of its uses.

In operation, the paper is placed on the spring loaded ramp platform. The user presses down on the ramp platform to overcome the spring force 27 and load the stack of documents face up. The paper is placed into the ramp platform so that the long 11" edge is the leading edge so that any location along the 8½" edge can be printed by stopping the track at the desired locations. If printing is to be adjacent the top 8½" edge, one lengthwise 11" side is inserted as the leading edge. If printing is to be adjacent the bottom 8½" edge, the opposite lengthwise 11" side is inserted as the leading edge. The keyboard 12 lets the user enter the print commands which can be viewed on the visual display 110. The sensors 29 sense the document presence of the paper in the ramp. Once the alphanumeric information and print location have been keyed in, an enter key is pressed. This activates first and second feeder pulleys to pull the top sheets of paper into the machine and then separator pulleys 36, 38, 40 and 42 separate the top sheet and guide the top sheet into the gap 50 between arcuate tracks 46 and 48 where inverter pulleys such as 56 and 57 cause the paper to go through a U-turn and be inverted and caused to stop at the center point of the inverting semi-circle on outside arcuate track 46 so that print head 64 can spray ink through gap 52 and print the selected characters at the desired location adjacent the 8½" top edge or 8½" bottom edge of the sheet of paper. After printing, the sheet of paper is continued to move in the gap 50 between tracks 46 and 48 by inverter pulleys 56 and 57 and thereafter, ejected onto the collection stacker tray 20 while a sensor 76 senses the trailing edge of the soon-to-be ejected sheet of paper and signals sensor 29 and feeder pulleys 30 to 32 to move the next top sheet of paper into the edge printer 10.

The present invention is a stand-alone edge printer which is not tied to a separate external computer.

In addition, the alphanumeric characters can be sequential so that each successive sheet of paper is imprinted with the next sequence alphanumeric character.

Another key innovation is that the self-contained edge printer of the present invention is small and lightweight so that it is portable and can be moved from office to office as desired.

Defined in detail, the present invention is a machine for imprinting characters adjacent the top edge or adjacent the bottom edge of a sheet of paper, comprising: (a) a keypad connected to an internal computer for entering print commands which will appear on a display screen; (b) a spring loaded ramp platform having a top edge and a bottom edge for receiving a stack of sheets of papers to be imprinted with characters, the ramp having stop members adjacent its lower edge to prevent the sheets of paper from falling out; (c) a document sensor adjacent the top edge of the spring loaded ramp to sense the presence of the document in the ramp; (d) a first feeder pulley and a parallel second feeder pulley to pull the sheets of paper into the machine; (e) a first top separator pulley and a parallel second top separator pulley, a first bottom separator pulley and a second parallel bottom separator pulley, the first top separator pulley intermeshed with the first bottom separator pulley, the second top separator pulley intermeshed with the second bottom separator pulley, the first and second top separator pulleys spinning in one direction and the first and second bottom separator pulleys spinning in the opposite direction to thereby separate the top sheet of paper from the stack of papers; (f) an outer arcuate track having a lengthwise portion extending into a semicircular portion extending into a downwardly sloping lengthwise portion, the outer arcuate track having a gap located at the midpoint of its semi-circular portion; (g) an inner arcuate track having a lengthwise portion extending into a semicircular portion extending into a downwardly sloping lengthwise portion, the inner arcuate track being parallel to and spaced apart from the outer arcuate track so that a gap is formed between the two tracks; (h) a multiplicity of inverter pulleys aligned with the inner and outer arcuate tracks; (i) a stationary inkjet printer having a print head aligned with the gap in the outer arcuate track; (j) a first ejection pulley and a parallel aligned second ejection pulley, the ejection pulleys located adjacent the ends of the downwardly sloping lengthwise portions of the outer and inner arcuate tracks, and leading to a collection stacker try; (k) a multiplicity of stepper motor means to drive all of the respective pulleys and an internal power supply to supply power to the multiplicity of stepper motor means; (l) a remote sensor located adjacent the remote ends of the downwardly sloping lengthwise portion of the outer and inner arcuate tracks to advise the document sensor that the imprinted sheet of paper is about to go into the collection stacker tray and to signal the feeder pulley to pull in the next sheet of paper; and (m) a sheet of paper is fed through the machine so that the document sensor senses the paper, the first and second feeder pulley pulls in sequentially stacked sheets of paper, the first and second top and bottom separator pulleys separate the top sheet of paper from the rest of the stack, the inverter pulleys guide the separated sheet of paper into the gap between the outer and inner arcuate tracks and as the desired imprinted location on the sheet of paper reaches the gap in the outer arcuate track, the print head of the inkjet printer imprints the desired characters on the sheet of paper, and thereafter the sheet of papers continues along the gap between the two arcuate tracks until it is fully inverted and the first and second ejection pulleys cause the sheet of paper to go into the collection stacker tray while the remote sensor provides a signal for the next sheet of paper to be imprinted.

Defined broadly, the present invention is a machine for imprinting characters adjacent the top edge or adjacent the bottom edge of a sheet of paper, comprising: (a) a keypad connected to an internal computer for entering print commands which will appear on a display screen; (b) a ramp platform having a top edge and a bottom edge for receiving a stack of sheets of papers to be imprinted with characters; (c) a document sensor adjacent the top edge of the ramp to sense the presence of the document in the ramp; (d) at least one bottom feeder pulley to pull the sheets of paper into the machine; (e) at least one separator pulley and at least one top separator pulley intermeshed with the at least one bottom separator pulley, the at least one top and bottom separator pulleys spinning in opposite directions to thereby separate the top sheet of paper from the stack of papers; (f) an outer arcuate track having a lengthwise portion extending into a semicircular portion extending into a downwardly sloping lengthwise portion, the outer arcuate track having a gap located at the midpoint of its semi-circular portion; (g) an inner arcuate track having a lengthwise portion extending into a semicircular portion extending into a downwardly sloping lengthwise portion, the inner arcuate track being parallel to and spaced apart from the outer arcuate track so that a gap is formed between the two tracks; (h) at least one inverter pulley aligned with the inner and outer arcuate tracks; (i) a stationary inkjet printer having a print head aligned with the gap in the outer arcuate track; (j) at least one ejection pulley located adjacent the ends of th downwardly sloping lengthwise portions of the outer and inner arcuate tracks, and leading to a collection stacking tray; (k) at least one stepper motor to respectively drive the pulleys and an internal power supply to supply power to the at least one stepper motor; (l)a remote sensor located adjacent the remote ends of the downwardly sloping lengthwise portion of the outer and inner arcuate tracks to advise the document sensor that the imprinted sheet of paper is about to go into the collection stacker tray and to signal the at least one feeder pulley to pull in the next sheet of paper; and (m) a sheet of paper is fed through the machine so that the document sensor senses the paper, the at least one feeder pulley pulls in sequentially stacked sheets of paper, the at least one top and bottom separator pulleys guide the separated sheet of paper into the gap between outer and inner arcuate tracks at the location of the gap in the outer arcuate track, the print head of the inkjet printer imprints the desired characters on the sheet of paper, and thereafter the sheet of papers continues along the gap between the two arcuate tracks until it is fully inverted and the at least one ejection pulley causes the sheet of paper to go into the collection stacker tray while the remote sensor provides a signal for the next sheet of paper to be imprinted.

Defined more broadly, the present invention is a machine for imprinting characters adjacent the top edge or adjacent the bottom edge of a sheet of paper, comprising: (a) means for inputting commands to the machine so that the characters will be imprinted at the desired location adjacent an edge of the sheet of papers; (b) means for receiving a stack of papers to be sequentially imprinted with characters; (c) means to sense the presence of the document in the ramp; (d) means to feed the sheets of paper into the machine; (e) means to separate the top sheet of paper from the adjacent sheets of paper; (f) track means having a semicircular portion to cause the sheet of paper to be inverted as the sheet of paper is guided into the track means; (g) means to imprint the characters into the sheet of paper while it is in the semicircular portion of the track means so that the imprinting occurs during the inversion process; (h) means to eject the imprinted sheet of paper into a paper receiving means; and (i) means to signal the machine to cause the next sheet of paper to be pulled into the machine.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A machine for imprinting characters adjacent a top edge or adjacent a bottom edge of: a sheet of paper, comprising:

a. a keypad connected to an internal computer for entering print commands which will appear on a display screen;

b. a spring loaded ramp platform having a top edge and a bottom edge for receiving a stack of sheets of papers to be imprinted with characters, the ramp having stop members adjacent its bottom edge to prevent the sheets of paper from falling out;

c. a document sensor adjacent the top edge of the spring loaded ramp to sense the presence of the stack of sheets in the ramp;

d. a first feeder pulley and a parallel second feeder pulley to pull the sheets of paper into the machine;

e. a first top separator pulley and a parallel second top separator pulley, a first bottom separator pulley and a second parallel bottom separator pulley, the first top separator pulley intermeshed with the first bottom separator pulley, the second top separator pulley intermeshed with the second bottom separator pulley, the first and second top separator pulleys spinning in one direction and the first and second bottom separator pulleys spinning in the opposite direction to thereby separate a top sheet of paper from the stack of papers;

f. an outer arcuate track having a lengthwise portion extending into a semicircular portion extending into a downwardly sloping lengthwise portion, the outer arcuate track having a gap located at the midpoint of its semi-circular portion;

g. an inner arcuate track having a lengthwise portion extending into a semicircular portion extending into a downwardly sloping lengthwise portion, the inner arcuate track being parallel to and spaced apart from the outer arcuate track so that a gap is formed between the inner and outer arcuate tracks;

h. a multiplicity of inverter pulleys aligned with the inner and outer arcuate tracks;

i. a stationary inkjet printer having a print head aligned with the gap in the outer arcuate track;

j. a first ejection pulley and a parallel aligned second ejection pulley, the ejection pulleys located adjacent the ends of the downwardly sloping lengthwise portions of the outer and inner arcuate tracks, and leading to a collection stacker tray;

k. a multiplicity of stepper motor means to drive all of the respective pulleys and an internal power supply to supply power to the multiplicity of stepper motor means;

l. a remote sensor located adjacent the remote ends of the downwardly sloping lengthwise portion of the outer and inner arcuate tracks to advise the document sensor that the imprinted sheet of paper is about to go into the collection stacker tray and to signal the first and second feeder pulleys to pull in the next sheet of from the stack paper; and m. sheets of paper are fed through the machine so that the document sensor senses the paper, the first and second feeder pulley pulls in sequentially stacked sheets of paper, the first and second top and bottom separator pulleys separate the top sheet of paper from the rest of the stack, the inverter pulleys guide the separated sheet of paper into the gap between a location outer and inner arcuate tracks and as the desired imprinted to be on the sheet of paper reaches the gap in the outer arcuate track, the print head of the inkjet printer imprints desired characters on the sheet of paper, and thereafter the sheet of papers continues along the gap between the two arcuate tracks until the sheet is fully inverted and the first and second ejection pulleys cause the sheet of paper to go into the collection stacker tray while the remote sensor provides a signal for the next sheet of paper to be imprinted.

2. The machine in accordance with claim 1, wherein the print head imprints any desired combination of alphanumeric characters on a location adjacent the top edge of the sheet of paper, the alphanumeric characters being imprinted in a sequential manner on each successive sheet of paper.

3. The machine in accordance with claim 1, wherein the print head imprints any desired combination of alphanumeric characters on a location adjacent the bottom edge of the sheet of paper, the alphanumeric characters being imprinted in a sequential manner on each successive sheet of paper.

4. The machine in accordance with claim 1, wherein the machine is portable.

5. A machine for imprinting characters adjacent a top edge or adjacent a bottom edge of a sheet of paper, comprising:

a. a keypad connected to an internal computer for entering print commands which will appear on a display screen;

b. a ramp platform having a top edge and a bottom edge for receiving a stack of sheets of papers to be imprinted with characters;

c. a document sensor adjacent the top edge of the ramp to sense the presence of the stack of sheets in the ramp;

d. at least one feeder pulley to pull the sheets of paper into the machine;

e. at least one bottom separator pulley and at least one top separator pulley intermeshed with the at least one bottom separator pulley, the at least one top and bottom separator pulleys spinning in opposite directions to thereby separate the top sheet of paper from the stack of papers;

f. an outer arcuate track having a lengthwise portion extending into a semicircular portion extending into a downwardly sloping lengthwise portion, the outer arcuate track having a gap located at the midpoint of its semi-circular portion;

g. an inner arcuate track having a lengthwise portion extending into a semicircular portion extending into a downwardly sloping lengthwise portion, the inner arcuate track being parallel to and spaced apart from the outer arcuate track so that a gap is formed between the inner and outer arcuate tracks;

h. at least one inverter pulley aligned with the inner and outer arcuate tracks;

i. a stationary inkjet printer having a print head aligned with the gap in the outer arcuate track;

j. at least one ejection pulley located adjacent the ends of th downwardly sloping lengthwise portions of the outer and inner arcuate tracks, and leading to a collection stacking tray;

k. at least one stepper motor to respectively drive the pulleys and an internal power supply to supply power to the at least one stepper motor;

l. a remote sensor located adjacent the remote ends of the downwardly sloping lengthwise portion of the outer and inner arcuate tracks to advise the document sensor that the imprinted sheet of paper is about to go into the collection stacker tray and to signal the at least one feeder pulley to pull in a next sheet of paper; and m. sheets of paper are fed through the machine so that the document sensor senses the paper, the at least one feeder pulley pulls in sequentially stacked sheets of paper, the at least one top and bottom separator pulleys guide the separated sheet of paper into the gap between outer and inner arcuate tracks at the location of the gap in the outer arcuate track, the print head of the inkjet printer imprints desired characters on the sheet of paper, and thereafter the sheet of papers continues along the gap between the two arcuate tracks until it is fully inverted and the at least one ejection pulley causes the sheet of paper to go into the collection stacker tray while the remote sensor provides a signal for the next sheet of paper to be imprinted.

6. The machine in accordance with claim 5, wherein the print head imprints any desired combination of alphanumeric characters on a location adjacent the top edge of the sheet of paper, the alphanumeric characters being imprinted in a sequential manner on each successive sheet of paper.

7. The machine in accordance with claim 5, wherein the print head imprints any desired combination of alphanumeric characters on a location adjacent the bottom edge of the sheet of paper, the alphanumeric characters being imprinted in a sequential manner on each successive sheet of paper.

8. The machine in accordance with claim 5, wherein the machine is portable.

* * * * *